US005192829A

United States Patent [19]

Suire

[11] Patent Number: 5,192,829

[45] Date of Patent: Mar. 9, 1993

[54] INITIATION DEVICE FOR THE PROPULSIVE CHARGE OF AMMUNITION, FOR EXAMPLE TELESCOPED AMMUNITION, AND AMMUNITION IGNITED BY SUCH AN IGNITION DEVICE

[75] Inventor: Christian G. Suire, Bourges, France

[73] Assignee: Giat Industries, France

[21] Appl. No.: 824,320

[22] Filed: Jan. 23, 1992

[30] Foreign Application Priority Data

Jul. 31, 1991 [FR] France ..... 91 09725

[51] Int. Cl.[5] ..... F42B 5/045

[52] U.S. Cl. ..... 102/434; 102/204; 102/439; 102/470

[58] Field of Search ..... 102/204, 430, 433, 434, 102/439, 469–472, 521, 703

[56] References Cited

U.S. PATENT DOCUMENTS

| | | | |
|---|---|---|---|
| 2,956,500 | 10/1960 | Barr | 102/434 |
| 2,996,988 | 8/1961 | Kunz | 102/434 |
| 3,446,146 | 5/1969 | Stadler et al. | 102/470 |
| 3,547,030 | 12/1970 | Kamp | 102/430 |
| 4,763,577 | 8/1988 | Romer et al. | 102/430 |
| 4,802,415 | 2/1989 | Clarke et al. | 102/434 |
| 4,899,663 | 2/1990 | Thorn | 102/204 |

FOREIGN PATENT DOCUMENTS

| | | | |
|---|---|---|---|
| 0344098 | 11/1989 | European Pat. Off. . | |
| 661306 | 7/1938 | Fed. Rep. of Germany | 102/470 |
| 3740986 | 6/1988 | Fed. Rep. of Germany | 102/471 |
| 977160 | 3/1951 | France | 102/469 |
| 2343987 | 3/1976 | France . | |
| 8808510 | 11/1988 | PCT Int'l Appl. | 402/439 |
| 9105981 | 5/1991 | PCT Int'l Appl. | 102/439 |

*Primary Examiner*—Harold J. Tudor
*Attorney, Agent, or Firm*—Parkhurst, Wendel & Rossi

[57] ABSTRACT

The invention relates to an ignition device for the propulsive charge of a telescoped piece of ammunition, including a case (2) that is generally cylindrical in shape in which are housed a pyrotechnic composition (3) and a device (4) for ignition thereof. The case (2) has at least one end wall (6) traversed by several channels (10) which each extend along an axis (A1) that slopes in relation to the centre line (A) of the case (2). This device enables all the propulsive charge of a round of ammunition of the telescoped type to be ignited almost immediately.

1 Claim, 2 Drawing Sheets

INITIATION DEVICE FOR THE PROPULSIVE CHARGE OF AMMUNITION, FOR EXAMPLE TELESCOPED AMMUNITION, AND AMMUNITION IGNITED BY SUCH AN IGNITION DEVICE

BACKGROUND OF THE INVENTION

1. Field of the Invention

The present invention relates to an ignition device for propulsive charge of a ammunition round including the telescoped type having a casing that is generally cylindrical in shape in which a pyrotechnical composition and a device for igniting the composition are housed.

Generally, the propulsive charge of an ammunition round is ignited using an ignition device, usually called an igniter, which protrudes through the base of the round into the body of the propulsive charge.

2. Background Art

Patent FR-2 343 987 describes a traditional ignition tube intended for artillery ammunition including a cylindrical case housing a pyrotechnic charge and an ignition element therefor, for example, a fuse activated from the outside using a striking pin. The casing is extended via a tubular component which contains an ignition charge consisting of annular compressed blocks of black powder. The free end of the tubular component is closed with a combustible cap which is ejected and burnt by the gases of combustion from the charge. Radial openings are distributed along the length of the tubular component and are closed off with covers that are broken by the pressure from the gases. Thus, flames produced by the pyrotechnic charge may reach parts of the propulsive charge located near to the opening. Therefore, the longer the tubular component, the deeper the penetration into the charge, and the more likely it is that the ignition of this charge will take place under better conditions, in relation to optimum conditions correspond to a virtual instantaneous ignition of the propulsive charge.

In the case of telescoped ammunition, the projectile is arranged inside the casing or case containing the propulsive charge, rather than protruding therefrom. Thus, it is possible to define a shorter ammunition round which enables more compact weapons or weapons with higher rates of firing to be designed. In order to maintain the same ballistic performance of traditional ammunition, the casing of the ammunition is filled with the greatest amount possible of the propulsive charge, including an annular layer of charge disposed around the projectile.

When the projectile of the telescoped ammunition includes, for example, a sub-projectile that terminates usually in a tail section, the result is that the distance separating this tail section from the base of the ammunition is inadequate to house therein a traditional igniter which has the power appropriate for the mass of the charge to be ignited. Designs utilizing a smaller, less powerful igniter do not permit virtual instantaneous ignition of the charge.

Another design, as described in documents U.S. Pat. Nos. 4,907,510, 4,846,069, 4,782,758 and 4,858,533, consists of dividing the propulsive charge into two parts which are ignited in succession. The first part of the charge is ignited by a low power ignition device.

However, this ammunition is complex because it requires the assembling of several finely engineered parts. Additionally the transition between combustion of the first charge and that of the second charge is difficult to control, which means there is the risk of reducing the output of the propulsive charge and therefore the performance of the ammunition.

An ignition device comprising fuses which traverse the propulsive charge is known from document EP-0 344 098. This design, developed for large calibre ammunition is, however, complicated to use.

SUMMARY OF THE INVENTION

The object of the invention include virtual instantaneous ignition of the propulsive charge with a device that is simple to use and which offers other advantages.

Therefore, the invention includes an ignition device of the aforementioned type, having a case having at least one end wall traversed by several channels which each extend along a sloping axis in relation to the center line of the casing.

Thus, as a result of the ignition of the pyrotechnic composition housed inside the case of the igniter, flames will spread to the outside of the case via channels following diverging directions in relation to the center line of the case.

The present invention overcomes the problem of delayed ignition of a propulsive charge for telescoped ammunition, the present ignition device replaces a traditional igniter poorly suited for this type of ammunition, without need to modify the internal structure of the ammunition.

The angle of slope of the case channels is chosen so that there is no interference between the flames produced and the tail section of the projectile. According to a preferred embodiment of the invention, the center line traverses the casing of the ammunition in an area located beyond the median part (mid-point) of the ammunition casing. According to another preferred embodiment of the invention, the ignition device is supplemented by support devices intending to axially secure the projectile inside the ammunition, particularly when the projectile has a tail section, whose fins rest on the igniter, each channel of the casing opening between two adjacent fins.

DETAILED DESCRIPTION OF THE DRAWINGS

Figure 1:
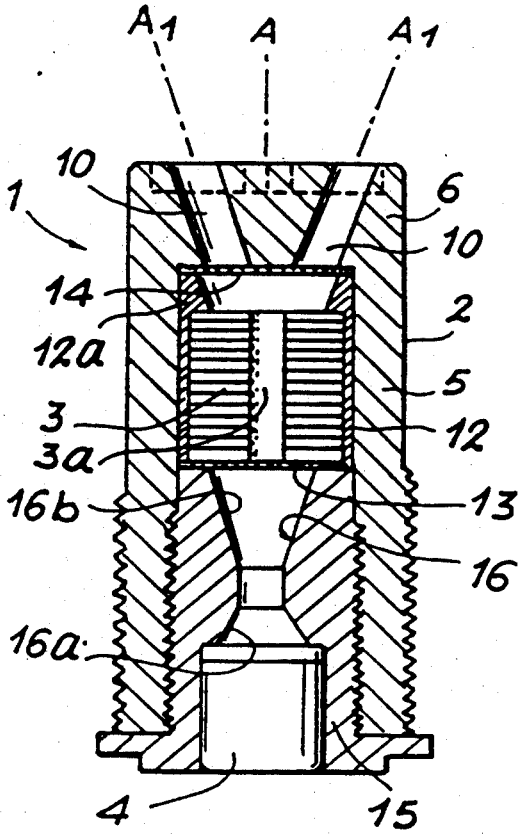
Figure 3:
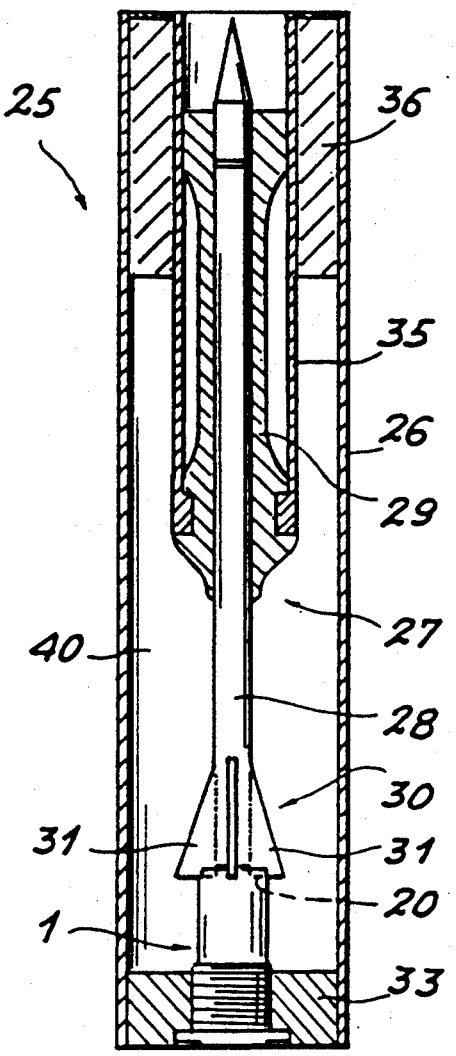
Figure 2:
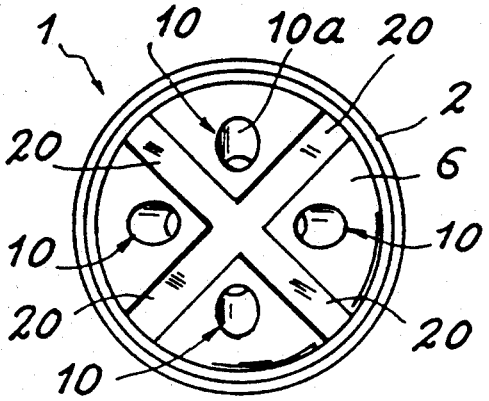
Figure 4:
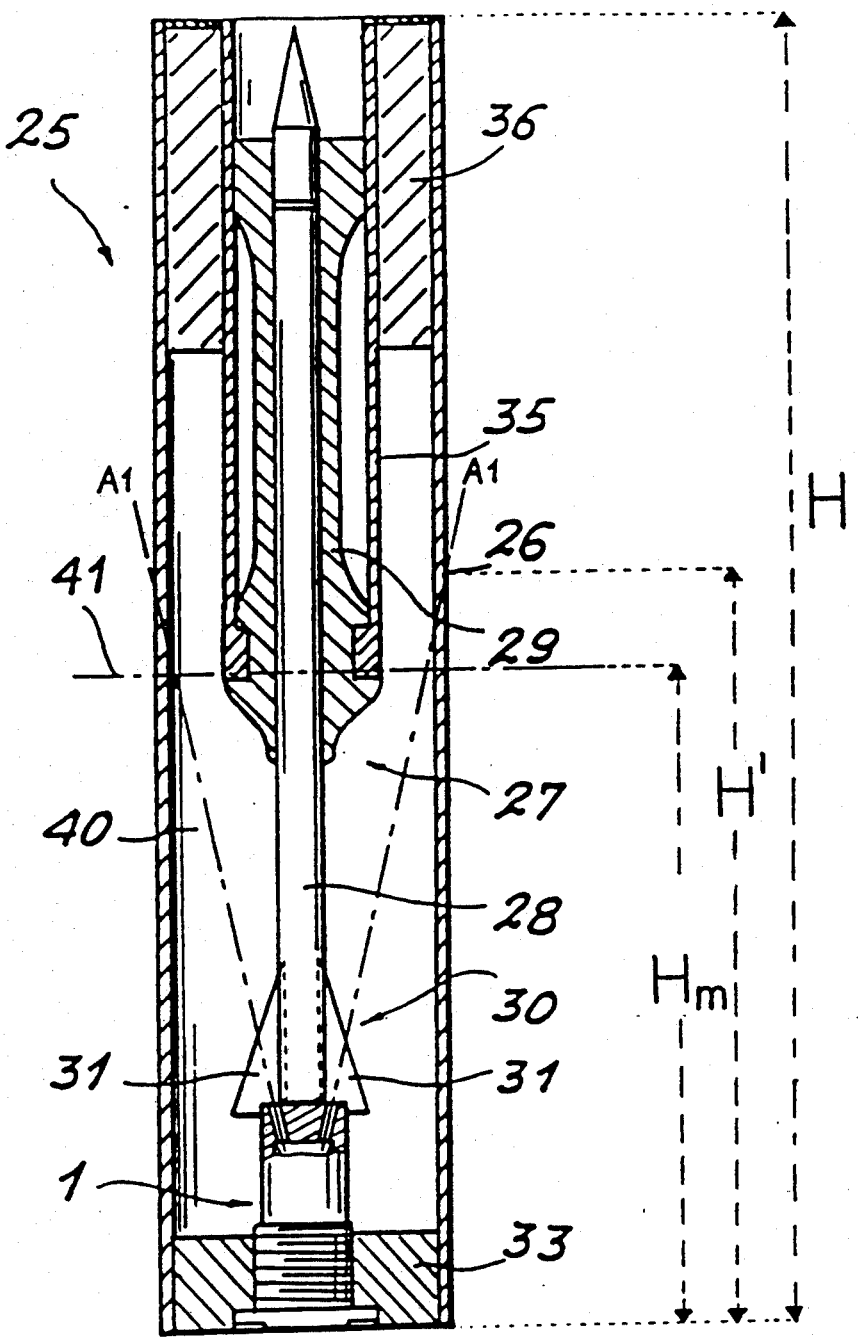

Further advantages, features and details of the invention will emerge from the description which follows of example embodiments and from the accompanying drawings in which:

FIG. 1 is an axial cross section of an ignition device conforming to the invention, FIG. 2 is a plan view of FIG. 1, FIG. 3 is a diagrammatic axial cross section of a portion of telescoped ammunition fitted with an ignition device conforming to the invention, and FIG. 4 is a diagrammatic cross-section showing the intersection of the center lines of the channels with the casing.

The ignition device 1 according to the invention as shown in FIG. 1, comprises a rigid casing 2 that is generally cylindrical housing, in a known manner a pyrotechnic composition 3 and an ignition device 4 such as a percussion cap, for example, to ignite the pyrotechnic composition 3 which is in a compressed form. The pyrotechnic composition 3 is a composition that generates flame, for example a boron/potassium nitrate composition in the proportions of 23% and 76% respectively, with a binder of 1% nitrocellulose and compacted at 1200 bar. The case 2 has a lateral cylindrical wall 5 closed at one end by an end wall 6 pierced by several channels 10 with each one extending along an axis A1 that slopes in relation to the center line A of the case. In the example under consideration here, the bottom 6 is pierced with four channels 10 (FIG. 2) whose outlets are circumferentially evenly spaced at 90° intervals. The casing of these channels 10 thus forms a cone, each channel 10 extending along one generating line of this cone.

The pyrotechnic composition 3 is housed in a cylindrical casing formed by a sleeve 12 of which one end has a radially internal annular rim 12*a*. This sleeve 12 has an external diameter slightly less in size than the internal diameter of the casing, so that it can be inserted into the casing, with its rim 12*a* resting on a closing mat 14 which rests on the bottom 6 of the casing 2.

The sleeve 12 is closed by a partition 13 which improves the mechanical strength of the composition 3. The annular rim at 12*a* also enables an empty space e to be created between the compacted material of composition 3 and the closing mat 14. The compacted material also has an axial channel 3*a*. This axial channel 3*a* and the aforementioned space e are provided so that they increase the combustion surface of the composition to reduce combustion time. The ignition device 4 of the pyrotechnic composition 3 is supported by a support block 15. This support block 15 has a cylindrical shape and is axially traversed by a passage 16 at one end of which is mounted the ignition device 4. The passage 16 has first a converging profile 16*a* then a diverging profile 16*b* so that it gives the gases emanating from the cap 4 increased speed, resulting in rapid ignition of the composition 3.

The support block 15 is screwed into the case 2 with the free end of its passage opening into the pyrotechnic composition 3.

According to an improvement made to the ignition device 1 conforming to the invention, the external surface of the bottom wall 6 of the case 2 has four notches 20 arranged at 90° intervals and offset relative to the four outlets 10*a* of the channels 10. The purpose of these notches 20 will be explained below with reference to FIG. 3 which shows an ignition device 1 according to the invention mounted in a telescoped ammunition round 25.

The telescoped ammunition 25 is formed from a casing or case 26 in which is housed a projectile 27 of the sub-calibre type comprising a sub-projectile 28 that is rigid with a sabot 29 and terminates in a stabilizing tail section 30 comprising four fins 31 arranged at 90° intervals. The casing is closed at its rear end by a base 33 whereas at its front end, the sabot 29 is surrounded by a cover 35 with a ring 36 ensuring sealing between the casing 26 and the cover 35. The internal space 40 defined around the projectile 27 between the casing 26, the base 33 and the ring 36 is filled with a propulsive charge.

An ignition device 1 is advantageously used as shown in FIGS. 1 and 2. The projectile is housed inside the casing 26 so that its four fins 31 rest on the four notches 20 made in the external surface of the bottom 6 of the case 2 of the ignition device 1. These notches enable the projectile 27 to be both axially and radially stabilized.

In this example the projectile has a fin section comprising four fins. Where the fin section of the projectile has six fins, six notches 20 shall be made in the external surface in the bottom of the casing and a number of channels 10 shall be included between the notches.

Generally, the angle of slope of the channels 10 shall be preferably chosen so that each of the center lines of the channels 10 traverses the casing 26 in an area beyond the median part (midpoint) of the casing. The midpoint corresponds to height $H_m$, the intersection of a center line with casing 26 is shown as H' and the full height of the round is shown as H, as shown in FIG. 4.

As a variant, the notches 20 of the external surface of the bottom 6 of the case 2 may be, for example, made in a ring fitted axially onto the ignition device with, where necessary, insertion of cross pieces in order to be suitable for different sizes of projectiles.

I claim:

1. A telescoped ammunition cartridge, comprising:

a cartridge casing;

a projectile and propellant charge disposed within said cartridge casing; and an ignition device disposed at an aft end of said cartridge casing, said ignition device comprising:

(i) a cylindrical case having an end wall and a longitudinal axis; and (ii) a pyrotechnic composition and ignition means for igniting said pyrotechnic composition housed within said cylindrical case, said cylindrical case including a plurality of angled channels in said end wall for providing flame communication between said pyrotechnic composition and said propellant charge, each of said angled channels having a central axis angled relative to said longitudinal axis such that said central axis intersects said casing at a point beyond a mid-point of said casing wherein said projectile includes a plurality of fins at an aft section of said projectile; and support means for supporting said fins, said support means comprising a plurality of recesses in the end wall of said cylindrical case, said angled channels opening between said fins of said projectile.

* * * * *